United States Patent [19]

Cunningham

[11] Patent Number: 4,543,693

[45] Date of Patent: Oct. 1, 1985

[54] SAFETY BELT BUCKLES

[75] Inventor: Douglas J. Cunningham, Lutterworth, England

[73] Assignee: Britax (Wingard) Limited, England

[21] Appl. No.: 506,438

[22] Filed: Jun. 21, 1983

[30] Foreign Application Priority Data

Jul. 2, 1982 [GB] United Kingdom ..... 8219285

[51] Int. Cl.[4] ..... A44B 11/26

[52] U.S. Cl. ..... 24/640; 24/641

[58] Field of Search ..... 24/640, 641, 642, 643, 24/645, 646

[56] References Cited

U.S. PATENT DOCUMENTS

| | | | |
|---|---|---|---|
| 4,065,836 | 1/1978 | Stephenson | 24/641 |
| 4,136,425 | 1/1979 | Esner | 24/641 |
| 4,353,151 | 10/1982 | Ennerdal | 24/641 |
| 4,358,879 | 11/1982 | Magyar | 24/641 |
| 4,375,714 | 3/1983 | Korger | 24/640 |

FOREIGN PATENT DOCUMENTS

| | | |
|---|---|---|
| 1938779 | 7/1968 | Fed. Rep. of Germany . |
| 2052185 | 10/1969 | Fed. Rep. of Germany . |
| 2637075 | 8/1975 | Fed. Rep. of Germany . |
| 1262537 | 10/1969 | United Kingdom . |

*Primary Examiner*—William E. Lyddane
*Assistant Examiner*—Peter A. Aschenbrenner
*Attorney, Agent, or Firm*—Hayes, Davis & Soloway

[57] ABSTRACT

A buckle for a safety belt has a body in which a passageway is provided for receiving a tongue and a latch member movable transversely of the passageway between a latching position in which it engages with the latching formation to retain the tongue in the passageway, and a release position in which the tongue is displaceable by an ejector outwardly from the passageway from its retained position, the latch member being biased into its released position by a spring. A first toggle member pivots about a fulcrum on the latch and abuts a second toggle member which pivots about a fulcrum on the body. The toggle members have a first stable position in which the latch member is held in its latching position against the action of its biasing spring.

17 Claims, 20 Drawing Figures

SAFETY BELT BUCKLES

This invention relates to tongue and buckle fasteners for safety belts and more particularly to a fastener in which the distance of movement of a manually operated member necessary to release the fastener is relatively small.

With all tongue and buckle fasteners for safety belts, there is a rick of a so called half-latch condition arising in which the tongue is retained in the buckle without the latch of the latter being properly engaged. Half-latch conditions can arise both during insertion of the tongue and when the buckle has, unintentionally, been partially released. The present invention is concerned with minimizing the risk of half-latching.

According to the invention, a tongue and buckle fastener for a safety belt comprises a tongue having a latching formation thereon, and a buckle comprising a body in which a passageway is provided for receiving the tongue, a spring-loaded tongue ejector slidable in the passageway, and a latch member moveable transversely of the passageway between a latching position in which it engages with the latching formation to retain the tongue in the passageway, and a release position in which the tongue is displaceable by the ejector outwardly from the passageway from its retained position, the latch member being spring-biased into its released position, the buckle further comprising a first strut located for pivotal movement about a fulcrum on the latch and abutting a second strut which is located for movement relative to an abutment on the body, the struts being arranged to have a first stable position in which the latch member is held in its latching position against the action of its biasing spring, and a second position in which the latch member is in its released position, locking means being arranged to initiate movement of the struts to their first stable position when the tongue is inserted into the passageway, and manually operable release means being arranged to initiate movement of the struts into their second position.

If the struts are depressed part way between the two stable positions they will either return to their original position or complete movement of their other position under the action of the latch biasing spring. There is no intermediate stable position and no other spring in the toggle mechanism which can balance the latch biasing spring.

Several embodiments of the invention will now be described, by way of example, with reference to the accompanying drawings in which.

Figure 8:
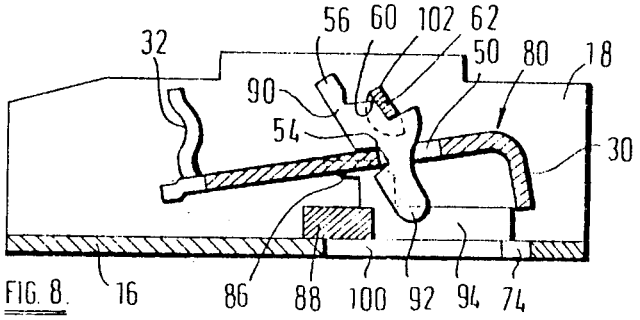
FIG. 8 is a simplified illustrative sectional view, similar to FIG. 2, of a second embodiment of the invention.
Figure 9:
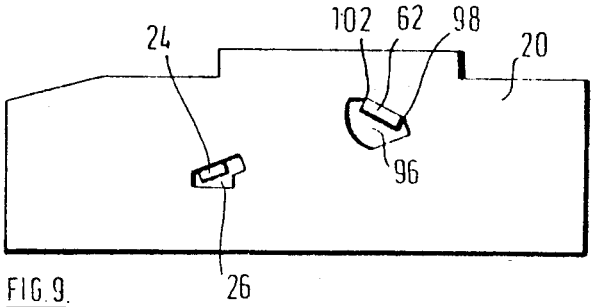
FIGS. 9 and 10 are views, similar to FIGS. 3 and 4, of the buckle shown in FIG. 8.
Figure 10:
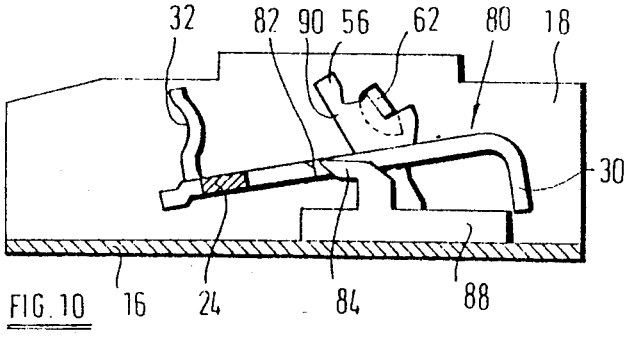
Figure 11:
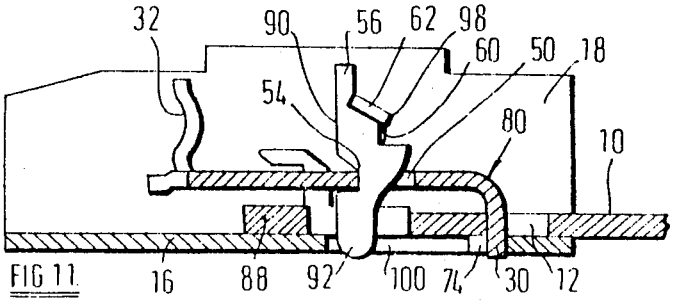
FIG. 11 is a simplified illustrative sectional view of the buckle shown in the fully latched position.
Figure 15:
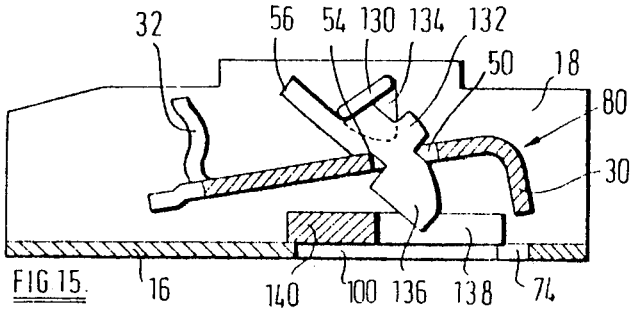
Figure 16:
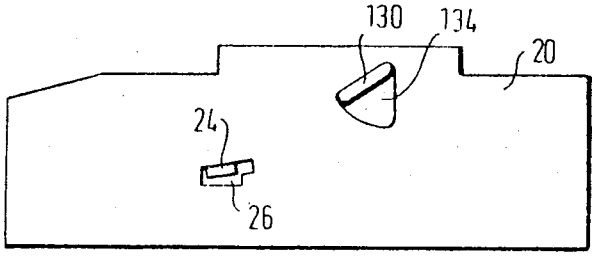
Figure 17:
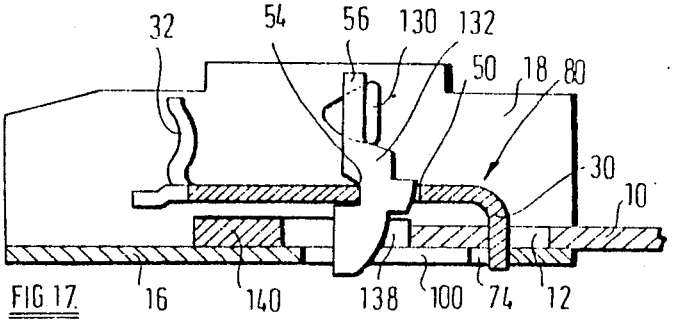
Figure 18:
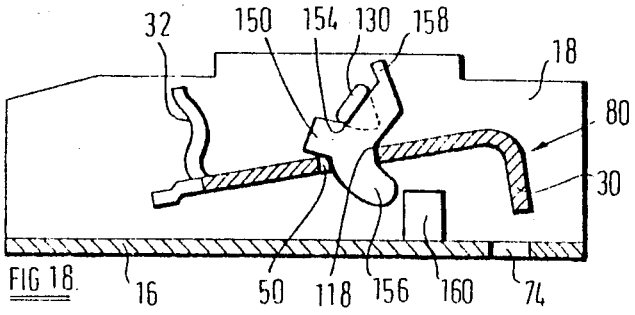
Figure 19:
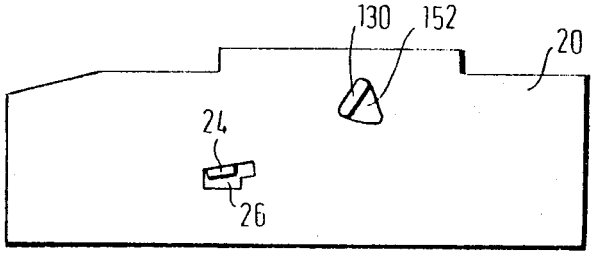
Figure 20:
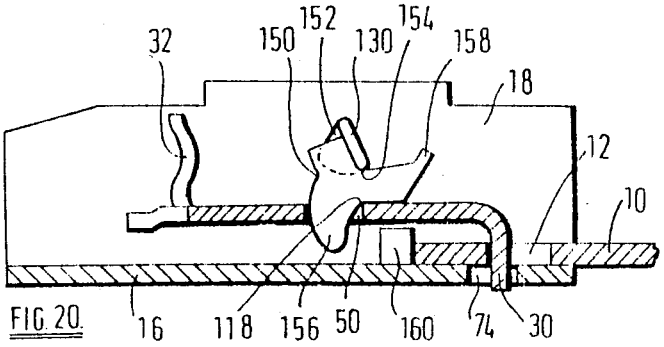

FIGS. 15, 16 and 17 are views similar to FIGS. 8, 9 and 10 respectively of a fourth embodiment of the invention; and FIGS. 18, 19 and 20 are views similar to FIGS. 8, 9 and 10 respectively of a fifth embodiment of the invention.

Figure 1:
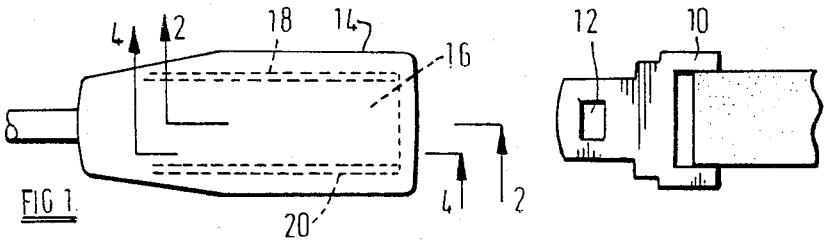
FIG. 1 is a plan view of a buckle in accordance with the invention, showing the buckle in its release position.
Figure 2:
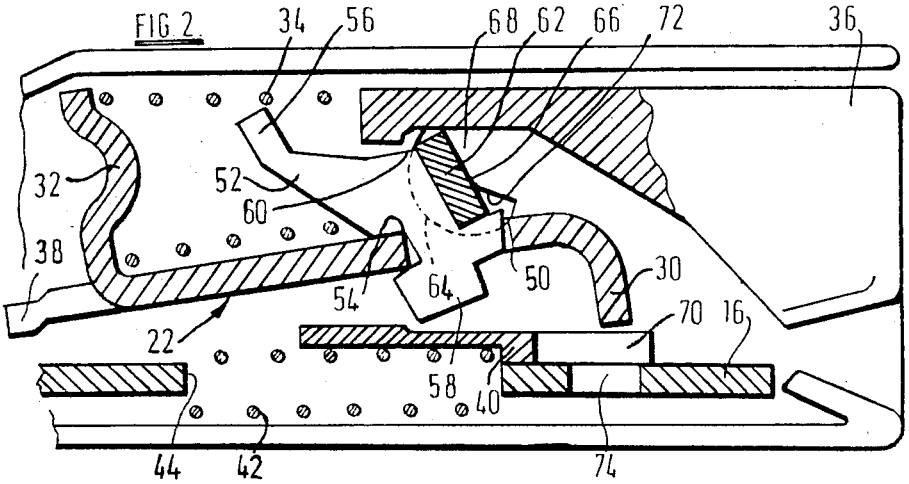
FIG. 2 is an illustrative sectional view, taken on the line 2—2 in FIG. 1.
Figure 3:
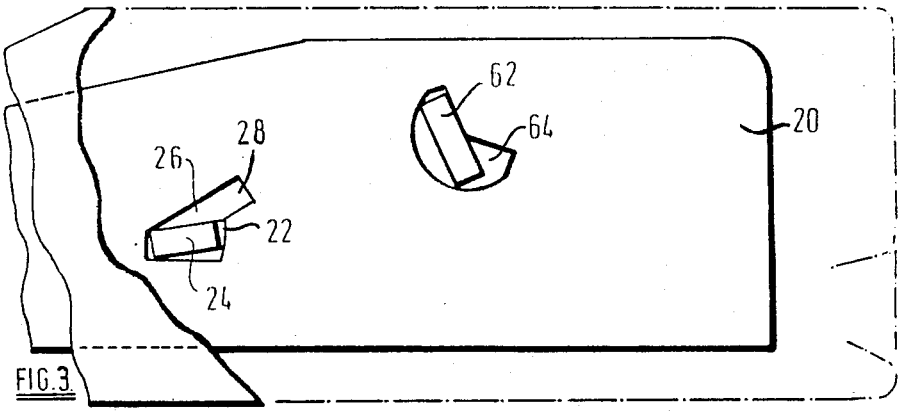
FIG. 3 is a side view of the buckle shown in FIGS. 1 and 2, with the case partially broken away.

Referring to FIGS. 1 to 3, a tongue and buckle fastener in accordance with the invention has a tongue 10 with a rectangular opening 12 near its free end for engagement with the latch of a buckle 14, as will be described hereinafter.

The buckle 14 has a channel-shaped frame member with a base portion 16 and two upstanding side walls 18 and 20. A latch 22 has side lugs 24 which are received in sector-shaped openings 26 in the side walls 18 and 20 so as to permit pivotal movement. The openings 26 have extensions 28 beyond the normal range of angular movement of the latch 22 to permit it to be skewed at an angle to its normal position so as to allow insertion of the lugs 24 during assembly. The latch 22 has a claw 30 on its free end for entry into the opening 12 in the tongue, and an upstanding limb 32 for engagement with one end of a compression spring 34, the other end of which engages with a push button 36 which is slidable on guide means (not shown) secured to the side walls 18 and 20. At the opposite end to the claw 30, the latch 22 has a heel 38 which projects into the path of a tongue ejector 40 which is slidable along the base portion 16 of the frame and is biased towards the right, as viewed in the drawings, by a compression spring 42 mounted in a slot 44 in the base portion 16.

The latch 22 has a rectangular opening 50 near the end carrying the claw 30. A first strut 52 projects through the opening 50 and pivots on edge 54 thereof further from the claw 30. The strut 52 has an upper limb 56 which projects into the path of the push button 36 and a lower limb 58 which projects through the opening 50.

On the opposite side to the edge 54, the first strut 52 has an edge 60 which engages with one face of a second strut 62. The strut 62 comprises a flat metal strip which is received in sector-shaped openings 64 in the side walls 18 and 20. The openings 64 extend over more than 180° and the strut 62 pivots on the corner 66 formed at the center of the circles of which the openings 64 are segments.

FIG. 2 shows the buckle in its released position, with the ejector 40 under the claw 30 and the second strut 62 held firmly against the upper radial edges 68 of the openings 64 by the spring 34 acting through the latch 22 and the first strut 52.

Figure 4:
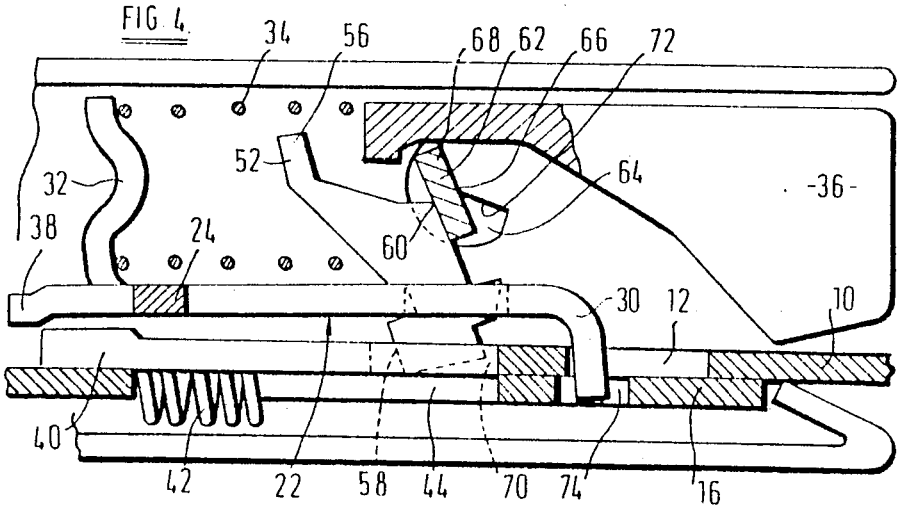
FIG. 4 is an illustrative sectional view taken on the line 4—4 in FIG. 1 but showing the buckle in an intermediate condition during insertion of the tongue.

Turning to FIG. 4, when the tongue 10 is inserted into the buckle 14, it displaces the ejector 40 to the left, compressing the spring 42. The inner end of the ejector 40 engages with the heel 38 on the latch 22, moving it clockwise so that the claw 30 projects through the opening 12 in the toggle, the limb 58 of the first strut 52 being received in an open-ended slot 70 in the ejector 40. However, the point at which the edge 60 of the first strut 52 engages with the second strut 62 is still above and to the left of the straight line joining the edge 54 of the opening 50 in the latch 22 and the corners 66 of the openings 64, with the result that the second strut 62 remains in contact with the radial edge 68 thereof.

Figure 5:
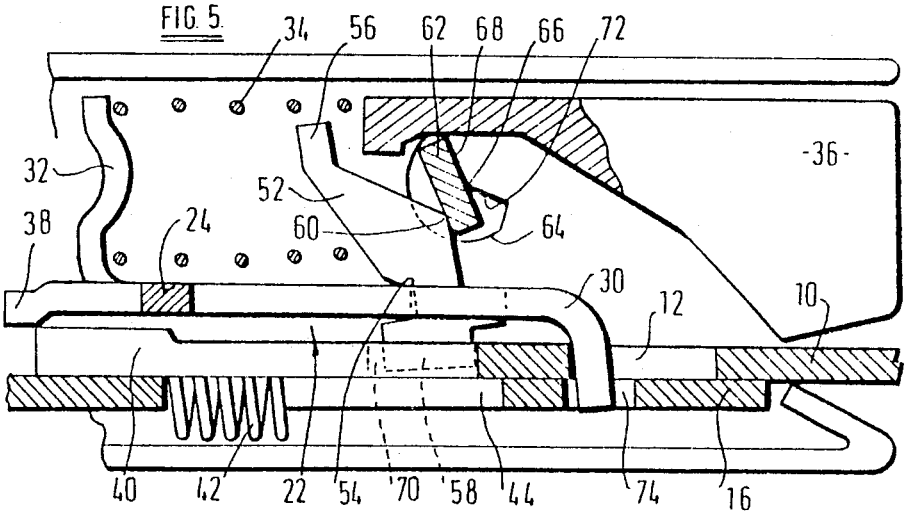
FIG. 5 is an illustrative sectional view taken on the line 4—4 in FIG. 1 and showing the buckle just prior to completion of latching.

FIG. 5 shows the next stage of latching. As insertion of the tongue 10 continues, the leading edge thereof makes contact with the limb 58 of the first strut 52, pivoting it in the clockwise direction about the edge 54, thus sliding the edge 60 thereof along the confronting face of the second strut 62. The edges 54 and 60, and the corner 66 are now almost in a straight line, with the result that any further clockwise angular movement of the first strut 52 will cause the second strut 62 to pivot on the corner 66. On the other hand, if the force inserting the tongue 10 is removed before pivotal movement of the second member 62 commences, the spring 34 will cause the latch 22 to pivot back to its original position shown in FIG. 2, and the ejector 40 will eject the tongue.

Figure 6:
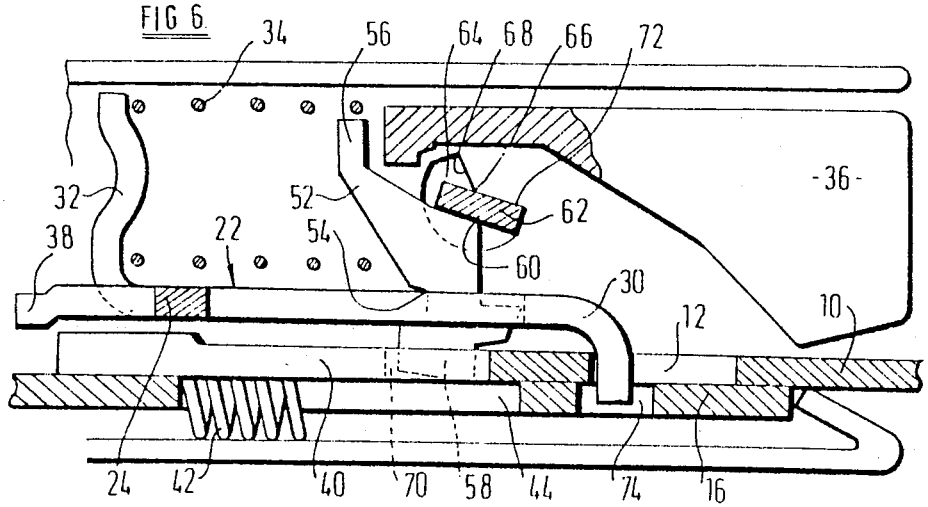
FIG. 6 is an illustrative sectional view taken on the line 4—4 in FIG. 1 but showing the buckle in its fully latched position.

Turning now to FIG. 6, if insertion of the tongue 10 continues beyond the position shown in FIG. 5, the edge 60 moves to the right of and below the line joining the edge 54 and the corners 66, with the result that the second strut 62 pivots into abutment with the radial edges 72 of the openings 64 and the two struts 52 and 62 are then held in the position illustrated by the action of the spring 34 on the latch 22. In this position, the two struts 52 and 62 block angular movement of the latch 22 in the anti-clockwise direction, and thus hold the claw 30 in the position illustrated in which it projects through the opening 12 in the frame member. When the insertion force on the tongue is released, the ejector 40 displaces the tongue 10 to the right, so as to press the left hand end of the opening 12 into abutment with the claw 30, and the claw 30 into abutment with the right hand edge of the opening 74 so that crash loads are transferred directly to the frame member of the buckle 14.

Figure 7:
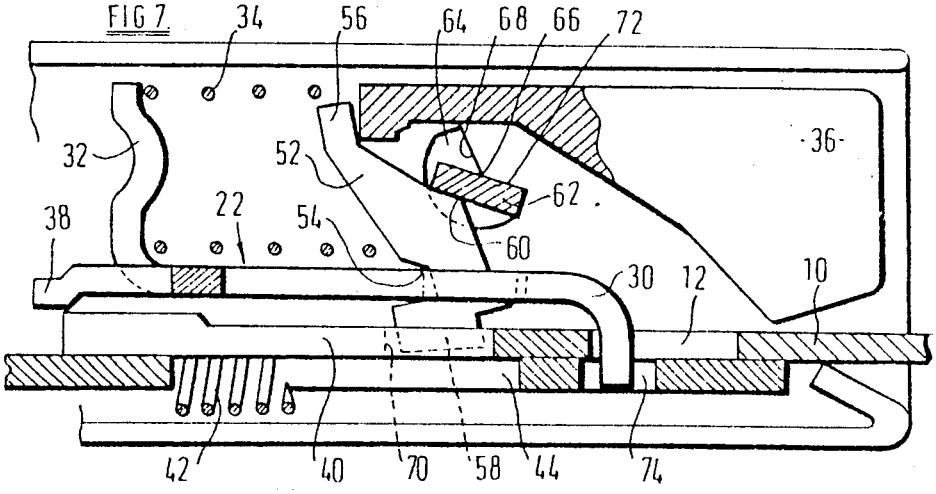
FIG. 7 is an illustrative sectional view, taken on the line 4—4 in FIG. 1 but showing the buckle in an intermediate position during release.

Turning now to FIG. 7, when the buckle is to be released, the push button 36 is depressed so that its inner end abuts against the limb 56 of the first strut 52, pivoting it in the anti-clockwise direction about the edge 54. In the position illustrated, the edge 60 is just about to come into alignment with the line joining the edge 54 and the corners 66 of the openings 64. Any further depression of the push button 36 will cause the edge 60 to go over-centre, whereupon the toggle will snap back into the position illustrated in FIG. 2 thus disengaging the claw 30 from the opening 12 in the tongue 10 and allowing the latter to be ejected by the ejector 40. On the other hand, if the push button 36 is released before the toggle has gone over-center, the first strut 52 returns to the position illustrated in FIG. 6.

It will be noticed that the position of the edge 60 in FIG. 7 is to the right of that illustrated in FIG. 4. Consequently, there is no intermediate position in which the toggle can be balanced; once it has gone over-center it completes its change of state, while before it has gone over-center, it returns to its initial state if the force causing it to change state is removed prematurely.

In FIGS. 8 to 14 of the drawings, only a simplified version of the mechanism is illustrated. In particular, the buckle case, the push button 36 and the spring 34 engaging between the push button 36 and the limb 32 of the latch are not shown in these drawings and it should be understood that these components are substantially the same as the corresponding components of FIGS. 1 to 7. Of the components which are illustrated in FIGS. 8 to 20, those which are substantially the same as the corresponding components of FIGS. 1 to 7 are denoted by the same reference numerals.

The latch 80 of the buckles shown in FIGS. 8 to 11 differs from the latch 22 of the buckle shown in FIG. 1 in that it does not have a heel 38. Instead, it has lateral shoulders 82 (FIG. 10) each of which co-operates with a respective upstanding projection 84, 86 on a modified ejector 88 so that, when the ejector 88 is pushed inwardly, the claw 30 of the latch 80 is moved downwardly (as viewed in the drawings) into the opening 74 in the base portion 16 of the buckle frame.

The second difference is that, instead of the first strut 52, the buckle shown in FIGS. 8 to 11 has a first strut 90 with a considerably extended lower limb 92 which not only projects through the opening 50 in the latch 30 but also extends, through a longitudinally extending slot 94 in the ejector 88, into the path of the tongue 10. Thirdly, the openings 96 in the side walls 18 and 20, which accommodate the second strut 62, extend over less than 90°.

The operation of this buckle is as follows. Starting from the release position illustrated in FIGS. 8, 9 and 10, the tongue 10 is inserted, depressing the ejector 88 against the action of its spring (not shown) and thus causing the projections 84 and 86 to engage with the shoulders 82 to pivot the latch 80 about its lugs 24. Consequently the edge 60 on the first strut 90 slides along the surface of the second strut 62 almost to the lower end thereof. When the tongue 10 has been inserted far enough to contact the lower limb 92 of the first strut 90, further inward movement of the former causes the latter to pivot about the edge 54 of the opening 50 with the result that the edge 60 causes the second strut 62 to pivot about the corner 98 of the opening 96. The two struts 90 and 62 then snap over to the position shown in FIG. 11, the lower limb 92 of the first strut 90 being received in a slot 100 in the base portion 16 which extends inwardly of the direction of tongue insertion from the opening 74. When the insertion load on the tongue 10 is released, the ejector 88 moves the tongue outwardly so that the edge of the opening 12 therein forces the claw 30 of the latch against the outer edge of the opening 74 in the base portion 16 of the frame member.

When the buckle is to be released, the push button (not shown) abuts against the upper limb 56 of the first strut 90, displacing it to the left (as viewed in the drawings) so that the strut 90 pivots about the edge 54 of the opening 50 in the latch member 80 and the edge 60 slides along the second strut 62 away from the corner 98. When the edge 60 has practically reached the other end of the second strut 62, the latter pivots about the corner 102 of the opening 96, allowing the latch 80 to release the tongue 10 and return to the position shown in FIG. 8.

Both during latching and releasing, if the insertion force on the tongue or the push button is released before the edge 60 has moved a sufficient distance along the second strut 62 to allow it to pivot on one or other of its corners 98 and 102, the mechanism reverts to its previous position.

Figure 12:
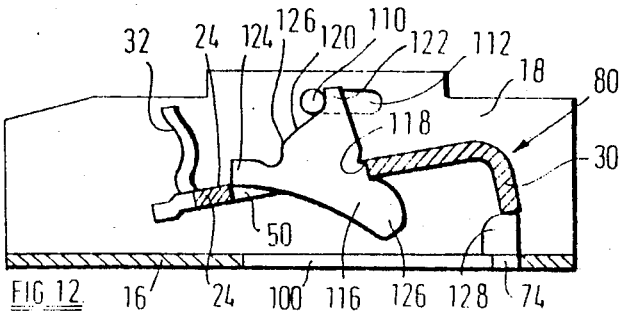
FIGS. 12, 13 and 14 are views similar to FIGS. 8, 9 and 10 respectively of a third embodiment of the invention.
Figure 13:
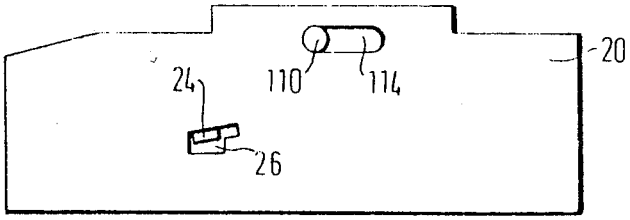
Figure 14:
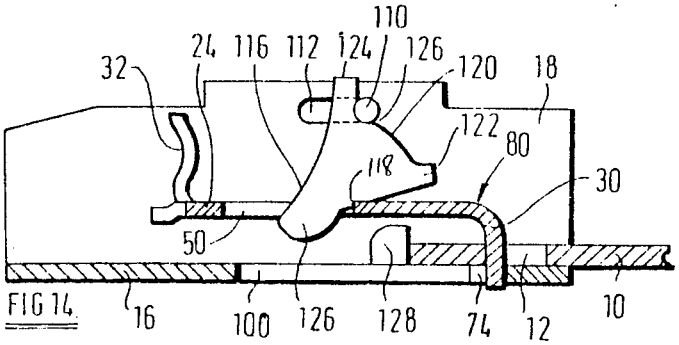

FIGS. 12, 13 and 14 illustrate another embodiment of the invention in which the second strut takes the form of a roller 110 which is received in slots 112 and 114 in the side walls 18 and 20 respectively. The first strut 116 pivots on the edge 118 of the opening 50 in the latch 80 nearer to the claw 30 and has a cam surface 120 which abuts against the roller 110 and has respective stops 122 and 124 at each end together with a high point 126 close to the stop 124. The strut 116 also has a limb 126 which projects into the path of a tongue ejector 128. The remaining components are similar to those already described and will not be described again in detail.

The operation of the buckle shown in FIGS. 12 to 14 is as follows. Starting from the position illustrated in FIGS. 12 and 13, when the tongue 10 is inserted, it first abuts against the ejector 128, bringing the latter into contact with the limb 126. The strut 116 then pivots on the edge 118, the roller 110 initially sliding over the surface 120. However as the angle between the surface 120 on the one hand and the walls of the slots 112 and 114 on the other decreases, the roller 110 starts to roll relative both to the surface 120 and the slots 112 and 114, thereby travelling along the latter. When the roller 110 reaches the high point 126, it snaps over into contact with the stop 124 and then slides the rest of the way along the slots 112 and 114 to the position illustrated in FIG. 14 in which the claw 30 projects through the opening 12 in the tongue into the opening 74 in the base portion 16.

When the buckle is to be released, the push button (not shown) is depressed, bringing it into abutment with the stop 124 on the first strut 116. Further depression of the push button causes the roller 110 to move along the slots 112 and 114 while remaining on the same side as the high point 126. When the roller 110 reaches the other end of the slots 112 and 114, further depression of the push button causes the latch 80 to move further into the engaged position, allowing the high point 126 to pass the roller 110, whereupon the mechanism snaps back to the position illustrated in FIG. 12 with the tongue 10 ejected.

As with previous embodiments, if either the tongue is released during insertion or the push button is released during disengagement before the roller 110 has passed the high point 126, the mechanism snaps back to its previous position.

The principal difference between the buckle illustrated in FIGS. 15, 16 and 17 and the buckle illustrated in FIGS. 1 to 7 is that the second strut 130 constitutes a flat metal strip which is oriented to transmit the load from the first strut 132 in a direction parallel to the flat side face of the former instead of perpendicular thereto, thus reducing any risk of the second strut bending when an excessive load is imposed on the buckle. The second strut 130 engages in a V-shaped recess formed between the upper limb 56 of the strut 132 and the main body thereof. The ends of the second strut 130 are received in sector-shaped openings 134 in the side walls 18 and 20, these openings extending over about 60°. The first strut 132 also has a lower limb 136 which projects through a longitudinal slot 138 in the outer edge (facing the tongue) of the ejector 140. The ejector 140 merely serves to impose an outward force on the tongue 10 and does not interengage with the latch 80.

When the buckle is to be fastened, the tongue 10 is inserted with the mechanism in the position shown in FIG. 15. Initially the end of the tongue 10 contacts the ejector 140 and displaces it to the left (as viewed in the drawings) until the end of the tongue 10 comes into contact with the lower limb 136 of the first strut 132. Further insertion of the tongue 10 causes the first strut 132 to pivot on the second strut 130 on the one hand and on the edge 54 of the opening 50 in the latch 80 on the other, with the result that the latch 80 pivots about the lugs 24, moving the claw 30 through the opening 12 in the tongue 10 and into the opening 100 in the base portion 16. When the toggle linkage formed by the two struts 130 and 132 goes over-center, the second strut 130 moves to the other end of the openings 134, bringing the mechanism into the position shown in FIG. 17. When the buckle is to be released, the push button (not shown) is depressed, so that it engages with the upper limb 56 of the first strut 132, displacing the toggle linkage back over-center and allowing the mechanism to return to the position shown in FIG. 15, the ejector 140 then ejecting the tongue 10.

FIGS. 18, 19 and 20 illustrate a modification of the embodiment shown in FIGS. 15, 16 and 17 in which the first strut 150 pivots on the edge 118 of the opening 50 in the latch 80 instead of on the edge 54 (FIG. 15). The second strut 130 is supported in openings 152 in the side walls 18 and 20 which are of substantially the same shape as the openings 134 but oriented somewhat differently. The first strut 150, although superficially of very different appearance, still has a V-shaped recess 154 in which the second strut 130 engages, and a lower limb 156 projecting through the opening 50 in the latch 80. However, the first limb 158, with which the push button (not shown) engages during the release operation, is on the side of the V-shaped groove 154 nearer to the side of the buckle from which the tongue 10 is inserted. Instead of the tongue 10 engaging directly with the lower limb 156 of the first strut 150, the necessary movement is transmitted by an ejector 160 similar to the ejector 128 of FIGS. 12, 13 and 14. Otherwise the operation of the buckle illustrated in FIGS. 18, 19 and 20 is the same as that of the buckle illustrated in FIGS. 15, 16 and 17.

It will be appreciated that any of the embodiments in which the tongue engages directly with the first strut may be modified by arranging for movement to be transmitted via the ejector and vice versa.

I claim:

1. A tongue and buckle fastener for a safety belt comprising a tongue having a latching formation thereon, and a buckle comprising a body in which a pssageway is provided for receiving the tongue, a spring-loaded tongue ejector slidable in the passageway, a latch member movable transversely of the passageway between a latching position in which it engages with the latching formation to retain the tongue in the passageway, and a released position in which the tongue is displaceable by the ejector outwardly from the passageway from its retained position, an abutment on the body located on the opposite side of the latch to the passageway, spring means for biasing the latch member into its released position, a first strut located between the latch member and the abutment and engaging with a fulcrum on the latch member for pivotal movement about said fulcrum, a second strut engaging between the first strut and the abutment, stop means on the body for limiting the struts to movement between a first stable position in which the struts hold the latch member in its latching position against the action of its biasing spring, and a second stable position in which the latch member is free to move into its released position, locking means comprising a projecting on the first strut extending into the passageway so as to initiate movement of the struts to their first position when the tongue is inserted into the passageway, and manually operable release means arranged to engage with the first strut to initiate movement of the struts into their second position, the first and second struts being so shaped and the stop means being so positioned relative to the abutment that the distance between the fulcrum and the abutment initially increases as the struts move from each of their stable positions towards the other stable position and is at a maximum when the struts are in a first intermediate position when moving from the first stable position to the second stable position and in a second intermediate position when the struts are moving from the second stable position to the first stable position, the first intermediate position being between the second intermediate position and the first stable position.

2. A fastener according to claim 18, wherein the locking means and the release means both abut against the first strut to cause said first strut to move the second strut.

3. A fastener according to claim 2, wherein the latch member is pivotally mounted on the body, the first strut extends through an opening in the latch member and the fulcrum comprises an edge of the opening.

4. A fastener according to claim 3, wherein the locking means comprises interengaging formations on the latch and the ejector.

5. A fastener according to claim 4, wherein the second strut comprises a bar which rocks on a fulcrum between said first stable position and said second stable position.

6. A fastener according to claim 5, wherein the fulcrum of the second strut comprises an edge.

7. A fastener according to claim 5, wherein the fulcrum of the second strut comprises a V-shaped recess.

8. A fastener according to claim 4, wherein the second strut has a single stable position in which it engages with a first surface of the first strut when the latter is in its first position and with a second surface thereof when in its second position, the second strut moving away from its stable position as the first strut moves between its first and second positions.

9. A fastener according to claim 4, wherein the second strut is a roller and the first strut has a cam surface with an intermediate high point at a greater distance from the fulcrum than the ends of said cam surface.

10. A fastener according to claim 4, wherein the biasing spring of the latch member engages between an abutment surface on the latch member and an abutment surface on the release means so as to bias the latter into its inoperative position.

11. A fastener according to claim 3, wherein the locking means comprises a limb of the first strut which projects into the passageway.

12. A fastener according to claim 11, wherein the second strut comprises a bar which rocks on a fulcrum between two stable positions.

13. A fastener according to claim 12, wherein the fulcrum of the second strut comprises an edge.

14. A fastener according to claim 12, wherein the fulcrum of the second strut comprises a V-shaped recess.

15. A fastener according to claim 11, wherein the second strut has a single stable position in which it engages with a first surface of the first strut when the latter is in its first position and with a second surface thereof when its second position, the second strut moving away from its stable position as the first strut moves between its first and second positions.

16. A fastener according to claim 11, wherein the second toggle member is a roller and the first strut has a cam surface with an intermediate high point at a greater distance from the fulcrum than the ends of said cam surface.

17. A fastener according to claim 11, wherein the biasing spring of the latch member engages between an abutment surface on the latch member and an abutment surface on the release means so as to bias the latter into its inoperative position.

* * * * *

UNITED STATES PATENT AND TRADEMARK OFFICE

CERTIFICATE OF CORRECTION

PATENT NO. : 4,543,693

DATED : October 1, 1985

INVENTOR(S) : Douglas James CUNNINGHAM

It is certified that error appears in the above—identified patent and that said Letters Patent is hereby corrected as shown below:

Claim 1, line 45, delete "pssageway" and insert in place thereof --passageway--.

Claim 2, line 16, delete "18" and insert in place thereof --1--.

Signed and Sealed this

*Twenty-eighth* Day of *January 1986*

[SEAL]

*Attest:*

DONALD J. QUIGG

*Attesting Officer* *Commissioner of Patents and Trademarks*